US010124617B2

(12) United States Patent
Sakai et al.

(10) Patent No.: US 10,124,617 B2
(45) Date of Patent: Nov. 13, 2018

(54) LIQUID STIRRER AND IMAGE FORMING APPARATUS INCLUDING SAME

(71) Applicants: Keitaroh Sakai, Kanagawa (JP); Nobuyuki Akaishi, Kanagawa (JP)

(72) Inventors: Keitaroh Sakai, Kanagawa (JP); Nobuyuki Akaishi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 337 days.

(21) Appl. No.: 14/729,389

(22) Filed: Jun. 3, 2015

(65) Prior Publication Data

US 2015/0360190 A1 Dec. 17, 2015

(30) Foreign Application Priority Data

Jun. 16, 2014 (JP) ..... 2014-123197

(51) Int. Cl.

| | |
|---|---|
| ***B01F 15/02*** | (2006.01) |
| ***B01F 15/00*** | (2006.01) |
| ***B41J 29/00*** | (2006.01) |
| ***B01F 3/08*** | (2006.01) |
| ***B01F 5/10*** | (2006.01) |
| ***B41J 2/175*** | (2006.01) |
| *B01F 3/00* | (2006.01) |

(52) U.S. Cl.

CPC ..... *B41J 29/00* (2013.01); *B01F 5/10* (2013.01); *B01F 15/00155* (2013.01); *B01F 15/00253* (2013.01); *B41J 2/175* (2013.01); *B01F 2003/0028* (2013.01); *B01F 2215/0059* (2013.01)

(58) Field of Classification Search

CPC .. B41J 2/175; B41J 2/211; B41J 2002/17589; B41J 2002/17576; B01F 5/10; B01F 5/108; B29B 7/7615

USPC ..... 366/136, 132

See application file for complete search history.

(56) References Cited

U.S. PATENT DOCUMENTS

| | | | | |
|---|---|---|---|---|
| 7,140,724 | B2 * | 11/2006 | Otis | B41J 2/1721 347/89 |
| 7,845,784 | B2 * | 12/2010 | Nitta | B41J 2/17596 347/89 |
| 2005/0146982 | A1 * | 7/2005 | Carlson | B01F 3/0865 366/136 |
| 2007/0206048 | A1 | 9/2007 | Kusunoki et al. | |

(Continued)

FOREIGN PATENT DOCUMENTS

| | | |
|---|---|---|
| JP | 2010-105390 | 5/2010 |
| JP | 2013-223986 | 10/2013 |

*Primary Examiner* — Tony G Soohoo
*Assistant Examiner* — Elizabeth Insler
(74) *Attorney, Agent, or Firm* — Cooper & Dunham LLP

(57) ABSTRACT

A liquid stirrer includes a removable first liquid container to contain a liquid; a second liquid container having a capacity less than that of the first liquid container; a fluid path between the first liquid container and the second liquid container; a reversible pump disposed on the fluid path; a sensor to detect an amount of the liquid inside the second liquid container, in which the liquid reciprocally moves between the first liquid container and the second liquid container; and a controller to control the reversible pump, based on readings from the sensor, such that a moving amount of the liquid does not exceed the capacity of the second liquid container and that the second container does not go empty.

19 Claims, 9 Drawing Sheets

(56) References Cited

U.S. PATENT DOCUMENTS

| | | | | |
|---|---|---|---|---|
| 2008/0291240 | A1 | 11/2008 | Ohsako et al. | |
| 2011/0050816 | A1 | 3/2011 | Katoh et al. | |
| 2012/0223981 | A1* | 9/2012 | Koike | B41J 2/175 347/6 |
| 2013/0235100 | A1* | 9/2013 | Kamiyama | B41J 2/175 347/6 |
| 2013/0278685 | A1 | 10/2013 | Nagasawa et al. | |

* cited by examiner

LIQUID STIRRER AND IMAGE FORMING APPARATUS INCLUDING SAME

CROSS-REFERENCE TO RELATED APPLICATION

The present application claims priority pursuant to 35 U.S.C. § 119(a) from Japanese patent application number 2014-123197, filed on Jun. 16, 2014, the entire disclosure of which is incorporated by reference herein.

BACKGROUND

Technical Field

The present invention relates to an image forming apparatus including a recording head to discharge a liquid, and in particular, relates to a liquid stirrer to stir a liquid, and to an image forming apparatus including the liquid stirrer.

Background Art

As an image forming apparatus, an inkjet recording apparatus employing liquid discharging recording method is known, in which a print head discharges ink droplets to form an image on recording media.

As for the ink, pigment ink is known, which employs pigment that is not easily dissolved in a solvent and thus tends to precipitate out. As a result, with ink lacking a uniform density and supplied to the recording head, the denser portion clogs the nozzle with precipitated ink. Accordingly, the pigment ink is stirred by moving the pigment ink between an ink cartridge and a second container, to prevent ingredient of the ink inside the ink cartridge from precipitating out of the solution.

SUMMARY

In one embodiment of the disclosure, there is provided an improved liquid stirrer including a removable first liquid container to contain a liquid; a second liquid container having a capacity less than that of the first liquid container; a fluid path between the first liquid container and the second liquid container; a reversible pump disposed on the fluid path; a sensor to detect an amount of the liquid inside the second liquid container, in which the liquid reciprocally moves between the first liquid container and the second liquid container; and a controller to control the reversible pump, based on readings from the sensor, such that a moving amount of the liquid does not exceed the capacity of the second liquid container and that the second container does not go empty.

In another embodiment of the disclosure, there is provided an improved image forming apparatus including the liquid stirrer as described above.

These and other objects, features, and advantages of the present invention will become apparent upon consideration of the following description of the preferred embodiments of the present invention when taken in conjunction with the accompanying drawings.

DETAILED DESCRIPTION

Hereinafter, preferred embodiments of the present invention will be described with reference to accompanying drawings.

A conventional liquid stirring device includes an ink tank to contain ink and a removable ink cartridge with a smaller capacity than that of the ink tank. This stirring device displaces ink between the ink tank and the ink cartridge, thereby agitating the ink contained in the ink cartridge actively, so that the precipitation of the ink content inside the ink cartridge can be prevented.

However, in the conventional liquid stirrer to stir the ink by moving the ink, the capacity of the secondary container should be greater than that of the ink cartridge. Consequently, if a large-capacity ink cartridge is mounted to a large-size apparatus, the secondary container should have a capacity greater than that of the large-size cartridge, necessitating a large space to mount such a container.

First Embodiment

Figure 1:
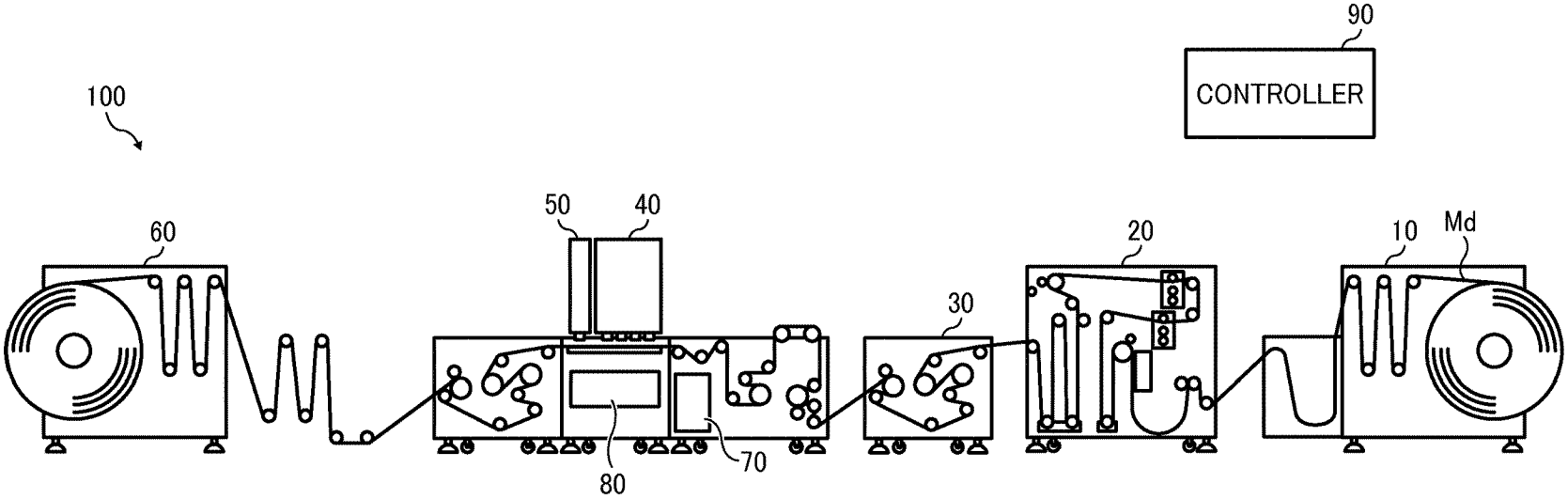
FIG. 1 schematically illustrates an image forming apparatus including a recording head to discharge a liquid droplet according to an embodiment of the present invention.

FIG. 1 schematically illustrates an image forming apparatus including a recording head to discharge a liquid droplet and to form an image on a recording medium. As illustrated in FIG. 1, an image forming apparatus 100 includes a conveyer 10, a pretreatment unit 20, a dryer 30, an image forming unit 40, a post-treatment unit 50, a discharge conveyer 60, an ink supplier 70, a head maintenance unit 80, and a controller 90.

A paper roll Md as recording media is a rolled-up continuous sheet or form with perforation.

The conveyer 10 conveys the paper roll Md and sends it to the pretreatment unit 20. The pretreatment unit 20 performs a pretreatment to a surface of the paper roll Md and sends it to the dryer 30. The dryer 30 dries the surface of the paper roll Md and sends it to the image forming unit 40.

The image forming unit 40 forms an image on the recording media. The recording head of the image forming unit 40 discharges a liquid droplet or ink to a surface of the paper roll Md to which the pretreatment and drying have been performed, thereby forming an image thereon.

The ink supplier 70 stirs the ink and to maintain uniform density thereof and supplies it to the recording head of the image forming unit 40.

The paper roll Md on which an image has been formed is conveyed to the post-treatment unit 50. The post-treatment unit 50 performs post-treatment to the paper roll Md on which the image has been formed, sends it to the discharge conveyer 60, which rolls us the paper roll Md. The above series of operation is controlled by the controller 90.

The recording media according to the present embodiment is not limited only to a paper roll, but may be cut paper, a normal sheet, grade paper, thin paper, thick sheet, an OHP sheet, synthesized resin film, metallic thin film, and any other material on which an image is formed with ink, and the like.

Figure 2:
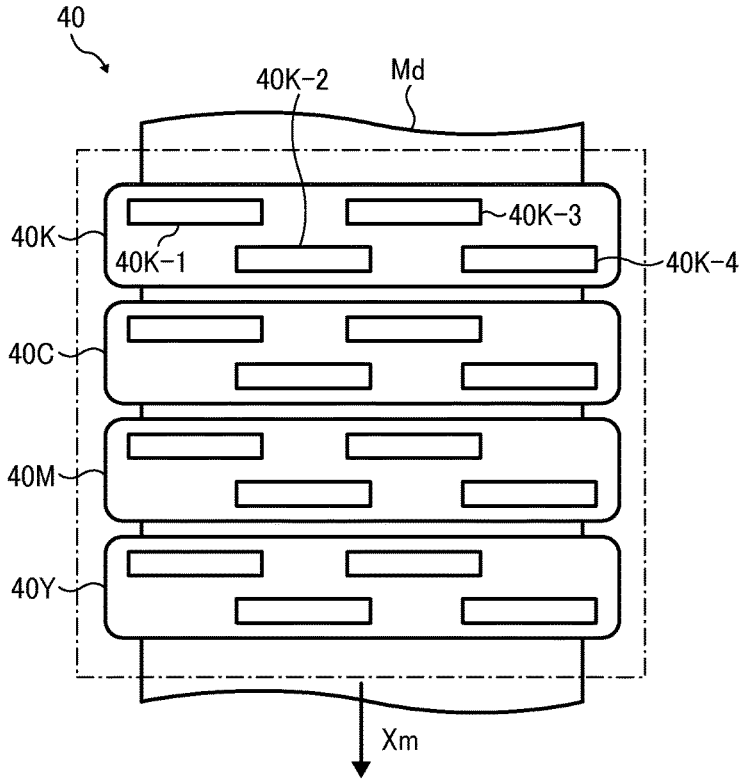
FIG. 2 is a plan view of an image forming unit illustrating a general configuration thereof.

FIG. 2 is a plan view of the image forming unit 40 illustrating a general configuration thereof. As illustrated in FIG. 2, the image forming unit 40 according to the present embodiment employs a full-line type recording head. Four recording heads 40K, 40C, 40M, and 40Y are disposed from upstream in the conveyance direction Xm of the paper roll Md to downstream. Suffixes of K, C, M, and Y respectively represent colors of black, cyan, magenta, and yellow. The order of the colors K, C, M, and Y is not limited to the exemplary order of FIG. 2, but any different order may be possible. In addition, the color of each recording head may be, for example, green, red, light cyan, and/or other colors. Alternatively, the color may be monochrome such as black only.

Herein, the recording head 40K for the color black (K) includes four head units 40K-1, 40K-2, 40K-3, and 40K-4 disposed in a staggered manner along a direction perpendicular to the conveyance direction Xm of the paper roll Md. With this structure, the recording head 40K can form a black image over an entire printable area of the paper roll Md. Other recording heads 40C, 40M, and 40Y are configured similarly to the recording head 40K for black (K).

Next, a description will be given of a liquid stirrer disposed inside the ink supplier 70.

Figure 3:
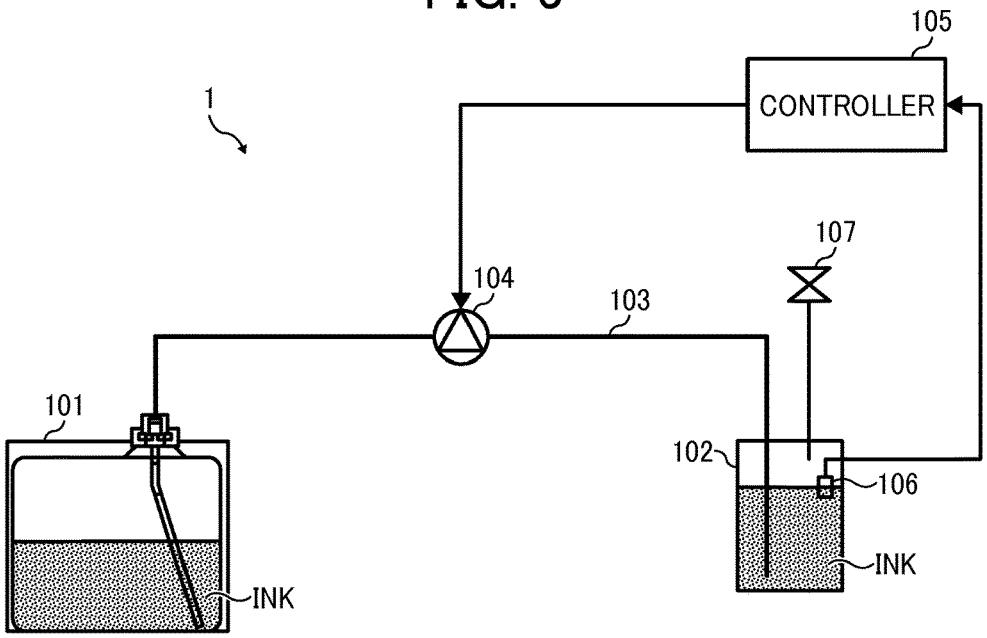
FIG. 3 schematically illustrates a liquid stirrer according to a first embodiment.

FIG. 3 schematically illustrates the liquid stirrer 1 according to a first embodiment. The liquid stirrer 1 according to the present embodiment stirs the liquid or the ink to achieve or maintain a uniform density thereof.

As illustrated in FIG. 3, the liquid stirrer 1 includes a cartridge or a first container 101, a second container 102, a pipe 103 communicating the cartridge 101 with the second container 102, and a ventilator 107. The liquid stirrer 1 further includes a reversible pump 104, a sensor 106, and a controller 105. Instead of the pipe 103, a flexible tube may be used for an easier handling.

The cartridge 101 contains ink and serves as a first, removable liquid container. The second container 102 serves as a second liquid container having a smaller capacity than that of the cartridge 101. The cartridge 101 and the second container 102 are connected via the pipe 103. The second container 102 includes a ventilator 107 serving as an air valve to keep an internal air pressure of the second container 102 constant and discharge the air mixed into the second container 102 when the cartridge 101 is detached or attached.

A reversible pump 104 to allow the ink to reciprocally move between the cartridge 101 and the second container 102 is disposed on the pipe 103. The reversible pump 104 may change a flow rate and direction of the ink flowing into the pipe 103.

The flow rate of the ink moved between the two containers can be calculated based on the quantity of the ink flowing inside the reversible pump 104. However, when air is mixed in the cartridge 101, calculation error may occur as to the ink flow rate. As a result, the error can be corrected by the sensor 106.

The sensor 106 to detect a level of the liquid is disposed at an upper part of the second container 102. The quantity of the ink inside the second container 102 can be calculated by a detected height of the liquid level of the ink, so that the ink quantity or the ink moving quantity calculated from the flow rate of the reversible pump 104 can be corrected. The sensor 106 can be used to detect an upper limit of the ink amount inside the second container 102. A capacitance level sensor, for example, may be used for the sensor 106.

The controller 105 is configured as a microcomputer, and controls a flow rate and flow direction of the reversible pump 104 based on readings from the sensor 106. Specifically, the controller 105 controls such that the amount of ink moving between the two containers does not exceed the capacity of the second container 102, and that the second container 102 does not go empty.

In addition, the controller 105 stores in memory a number of times of the ink movement or a number of times the ink has been pumped, date and time when the reversible pump 104 is driven (that is, stir date), and calculates time elapsed after the last stir date. The controller 105 can be replaced by the controller 90 that exerts overall control of the operations of the image forming apparatus 100.

Next, a description is given of the ink stirring method in the liquid stirrer 1.

First, the controller 105 determines a number of times the ink has been pumped based on the time elapsed after the last stir date. Next, the controller 105 controls a flowing direction of the reversible pump 104 so that the ink is conveyed from the cartridge 101 to the second container 102. The reversible pump 104 is driven to convey the ink. Next, upon the sensor 106 disposed on the second container 102 detecting an upper limit ink amount, the controller 105 stops the reversible pump 104 and stops sending the ink. Then, the controller 105 changes a direction of the flow of the reversible pump 104 such that the ink is conveyed from the second container 102 to the cartridge 101, and drives the reversible pump 104. The controller 105 stops the reversible pump 104 to stop the conveyance of the ink after the reversible pump 104 has moved a predetermined amount of ink. Up to here, the ink moves reciprocally back and forth once.

The reciprocal movement of the ink is performed for a first predetermined number of times, and the controller 105 stores in memory the stir date and the number of times pumped. The ink stirring is thus completed.

After a predetermined time has elapsed after the completion of the stirring, the liquid stirrer 1 again stirs the ink inside the cartridge 101.

As described above, the liquid stirrer 1 according to the present embodiment is configured such that the amount of ink moving between two containers does not exceed the capacity of the second container 102 and that the second container 102 does not go empty, so that the capacity of the second container 102 can be smaller than that of the cartridge 101. As a result, the liquid stirrer 1 itself can be made more compact.

In addition, the liquid stirrer 1 is configured to stir the ink inside the cartridge 101 regularly, so that the density of the ink can be kept constant for a long period of time.

Second Embodiment

Figure 4:
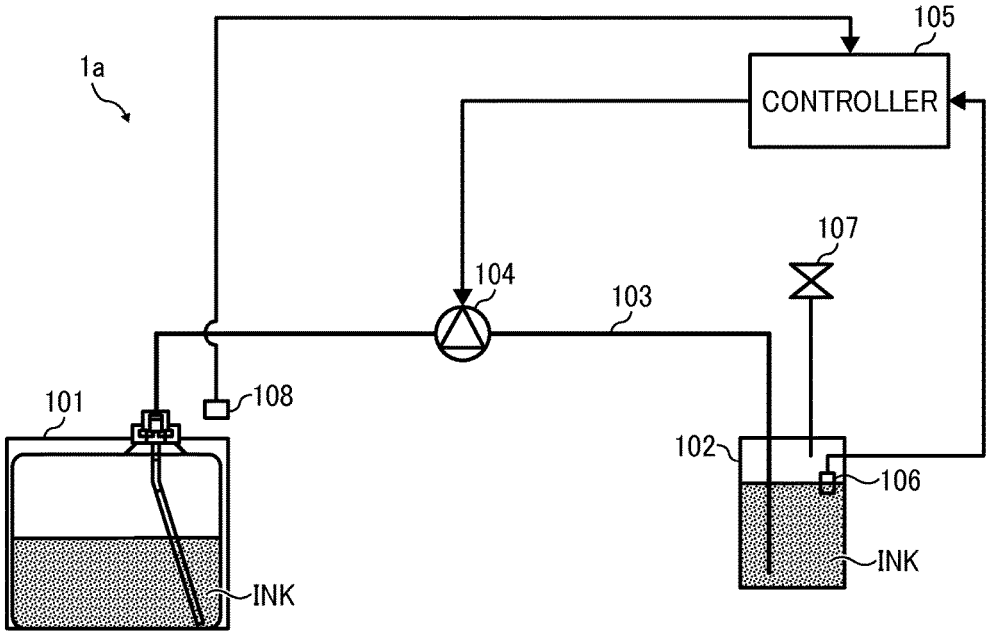
FIG. 4 schematically illustrates another liquid stirrer according to a second embodiment.

FIG. 4 schematically illustrates a liquid stirrer 1*a* according to a second embodiment. In FIG. 4, any parts or components similar to parts or components illustrated in FIG. 3 are given the same reference numerals and redundant description thereof is omitted.

In the liquid stirrer 1*a* according to the present embodiment, the cartridge 101 includes a storage device 108, which stores in memory and stores an identification number of the cartridge 101, a type of ink contained in the cartridge 101, an ink amount, and a stir date, and the like. The controller 105 obtains these pieces of information from the storage device 108, and determines frequencies of movement of ink and regular stirring.

With this arrangement, the liquid stirrer 1*a* stirs the content of the cartridge 101 better. In addition, even though the cartridge 101 may be erroneously from the apparatus, the cartridge 101 can be identified from the identification number. Further, because the stir date of the cartridge 101 can be obtained, the ink density can be maintained in a proper state.

Third Embodiment

Figure 5:
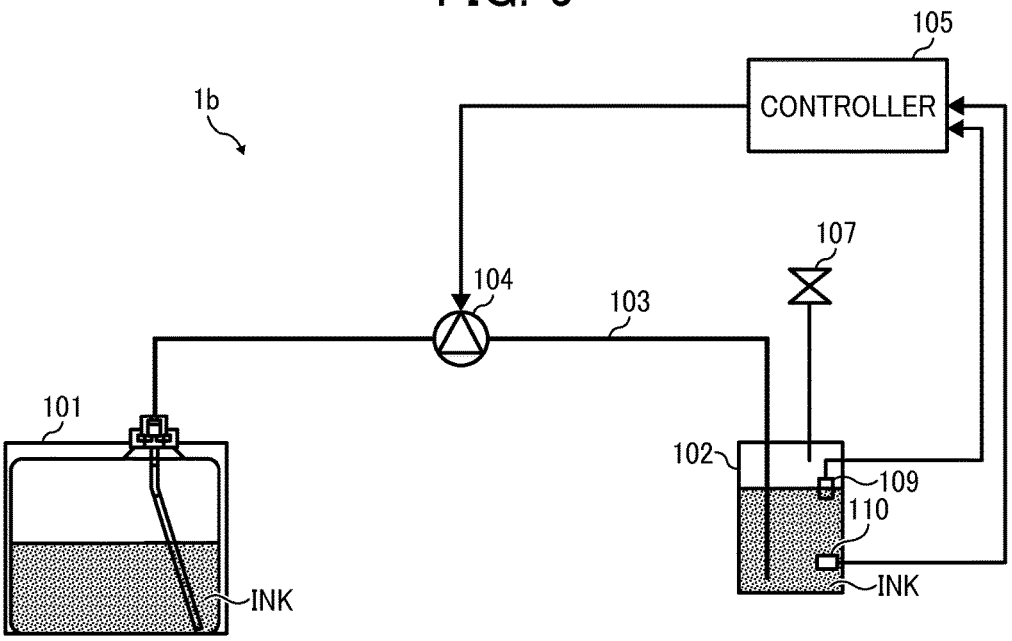
FIG. 5 schematically illustrates further another liquid stirrer according to a third embodiment.

FIG. 5 schematically illustrates a liquid stirrer 1*b* according to a third embodiment.

The liquid stirrer 1 according to the first embodiment includes the one sensor 106 disposed at the upper part of the second container 102. In the third embodiment, an upper sensor 109 and a lower sensor 110 are disposed at an upper and lower part of the second container 102, respectively.

The upper sensor 109 and the lower sensor 110 are level sensors each to detect a height of the ink liquid level, similarly to the above sensor 106. The upper sensor 109 is used to detect an upper limit of the ink liquid inside the second container 102, and the lower sensor 110 is used to detect a lower limit of the ink liquid inside the second container 102. The controller 105 only has to stop sending the ink when each sensor detects the liquid level, so that there is no need of calculating the moved ink amount based on the flow rate of the pump.

Accordingly, the liquid stirrer 1*b* according to the present embodiment can determine the moved ink amount with higher precision and accuracy than calculating the moved ink amount based on the flow rate of the pump that requires error correction. Thus, the second container 102 can be more compact, and the liquid stirrer as a whole can be more compact as well.

Fourth Embodiment

Figure 6:
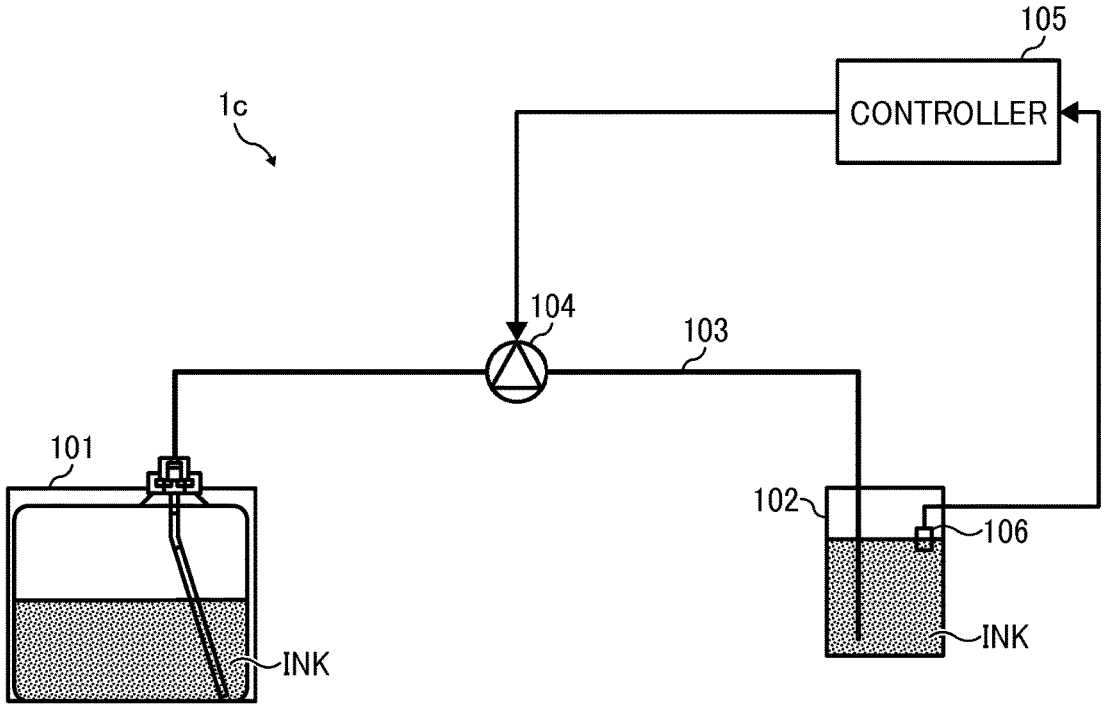
FIG. 6 schematically illustrates yet another liquid stirrer according to a fourth embodiment.

FIG. 6 schematically illustrates a liquid stirrer 1*c* according to a fourth embodiment.

The liquid stirrer 1*c* according to the present embodiment includes a second container 102 formed as a flexible container. The flexible container easily deforms, so that internal pressure thereof can be kept constant. Accordingly, the liquid stirrer 1*c* can do without a ventilator 107 that the second container 102 according to the first to third embodiment includes, thereby reducing the cost.

Fifth Embodiment

Figure 7:
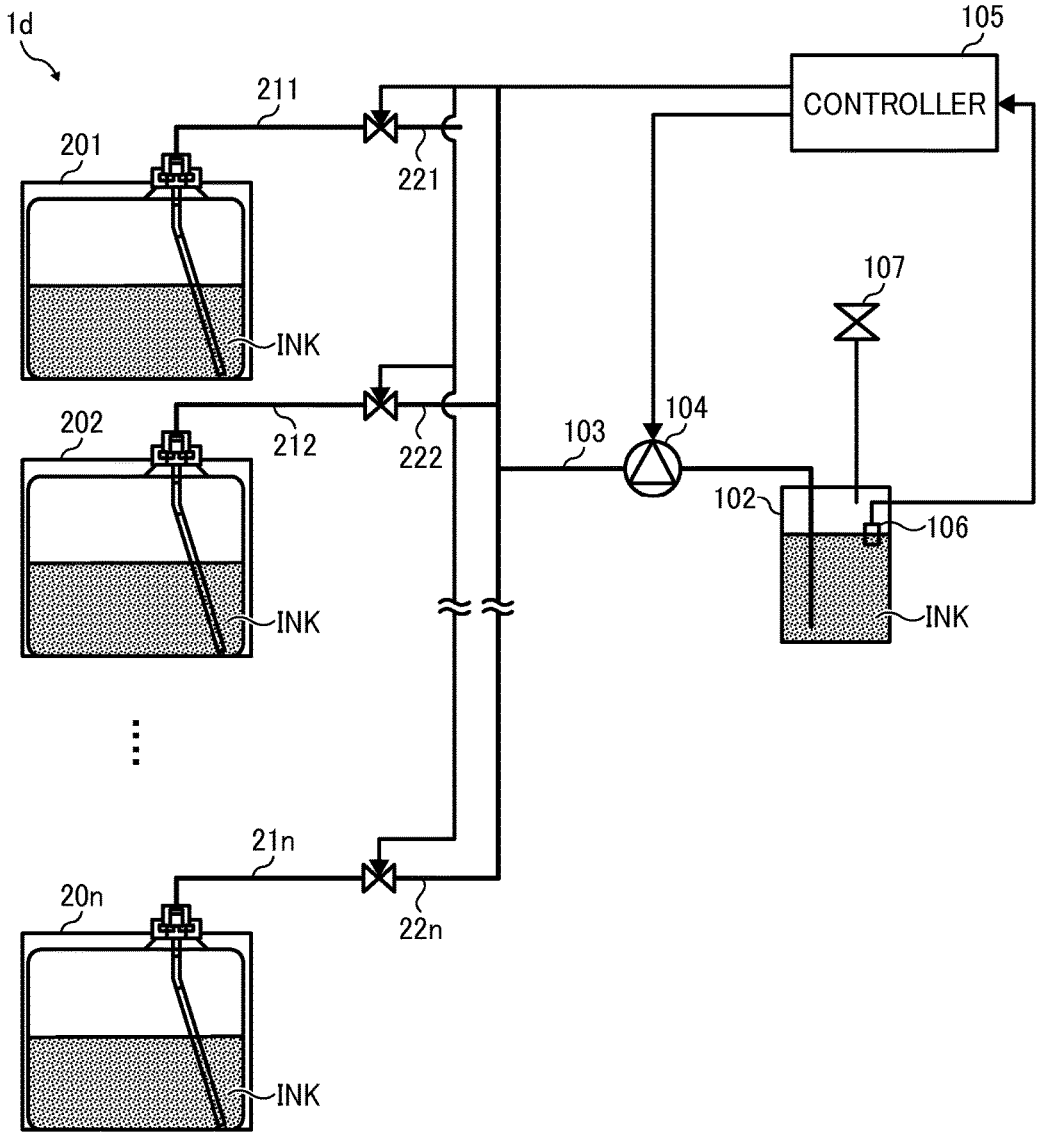
FIG. 7 schematically illustrates still another liquid stirrer according to a fifth embodiment.

FIG. 7 schematically illustrates a liquid stirrer 1*d* according to a fifth embodiment.

In the liquid stirrer 1*d* according to the present embodiment, each of a plurality of cartridges 201, 202, . . . , 20*n* (n being an integer greater than two) is connected to a corresponding pipe 211, 212, . . . , 21*n*. The pipes 211, 212, . . . , 21*n* each are provided with a gate valve to stop a flow of ink. Further, each of the pipes 211, 212, . . . , 21*n* is connected in parallel with the pipe 103 that connects to the second container 102. Opening and closing of the gate valve of the pipes 211, 212, . . . , 21*n* is controlled by the controller 105. The cartridges 201, 202, . . . , 20*n* in FIG. 7 each is the same as the cartridge 101 used in the first to fourth embodiments.

When the gate valve of the pipes 211, 212, . . . , 21*n* is sequentially switched, one of the cartridges 201, 202, . . . , 20*n* communicates with the second container 102. With this configuration, there is no need to replace the cartridge until the ink in all the cartridges has been used up, thereby reducing the downtime of the apparatus.

Sixth Embodiment

Figure 8:
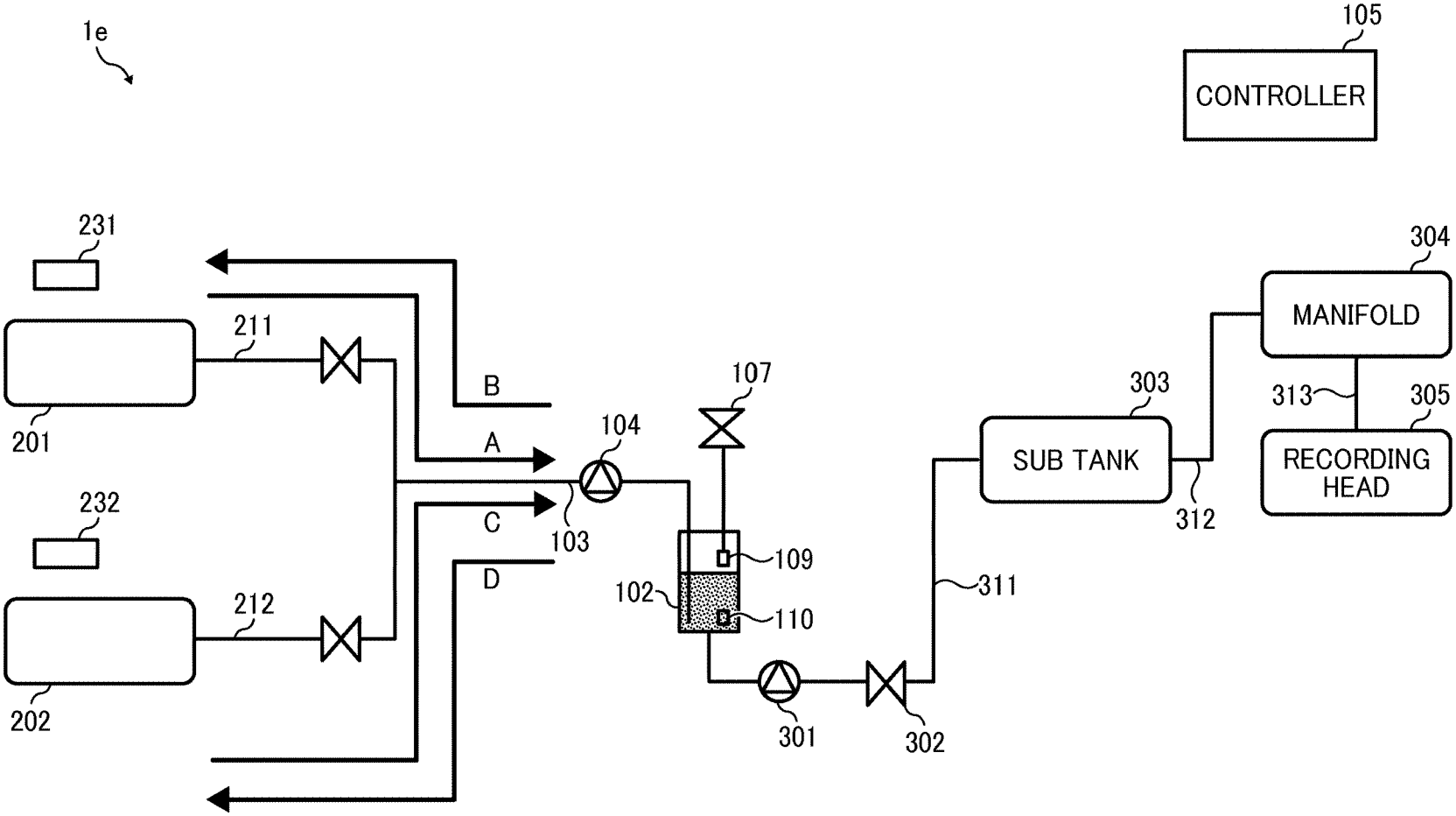
FIG. 8 schematically illustrates further another liquid stirrer according to a sixth embodiment.

FIG. 8 schematically illustrates a liquid stirrer 1*e* according to a sixth embodiment.

The liquid stirrer 1*e* according to the sixth embodiment includes structures as described in the second to fifth embodiments and aims to improve effect of stirring compared to the other embodiments.

Further, the liquid stirrer 1*e* according to the present embodiment includes pipes 211, 212 each with a gate valve, connected to the two removable cartridges 201, 202, respectively. Further, each of the pipes 211, 212 is connected in parallel with the pipe 103 that connects to the second container 102. In addition, each cartridge 201, 202 includes a storage device 231, 232, respectively, having the same function as that of the storage device 108 as illustrated in FIG. 4.

A pipe 311 is connected to a bottom of the second container 102, and the second container 102 is connected to a sub tank 303 via the pipe 311. A pipe 312 is connected to the sub tank 303, and the sub tank 303 is connected to a manifold 304 via the pipe 312. The manifold 304 is connected to a recording head 305 via a pipe 313.

An isolation valve 302 is disposed on the pipe 311 that communicates the second container 102 with the sub tank 303. When the isolation valve 302 is closed, effects of the stirring are not given to the manifold 304 nor the recording head 305. In addition, the pipe 311 includes a pump 301 to convey the ink downstream from the second container 102.

Although the signal line from the controller 105 is not illustrated, the controller 105 controls memories, sensors, pumps, and gate valves, similarly to the other embodiments.

Figure 9:
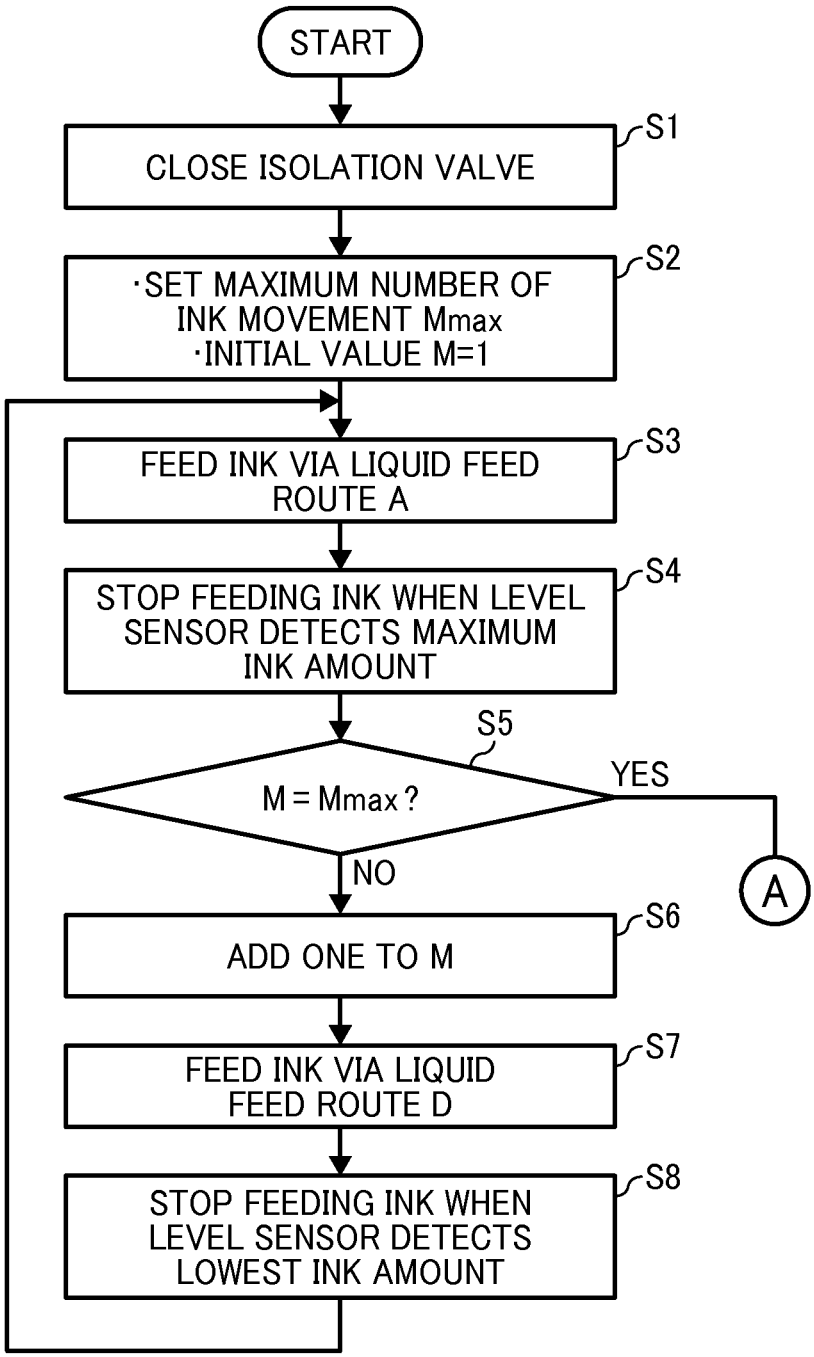
FIG. 9 is a flowchart illustrating stirring (first part) according to the sixth embodiment.
Figure 10:
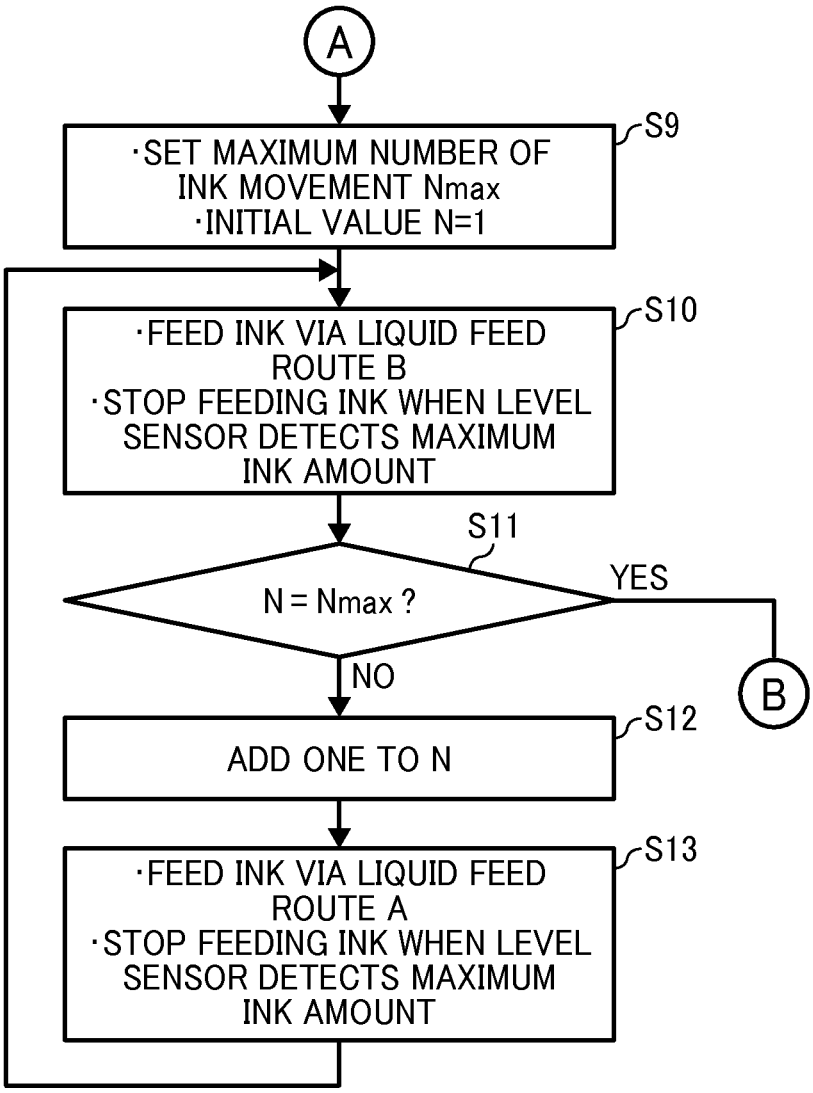
FIG. 10 is a flowchart illustrating stirring (second part) according to the sixth embodiment.
Figure 11:
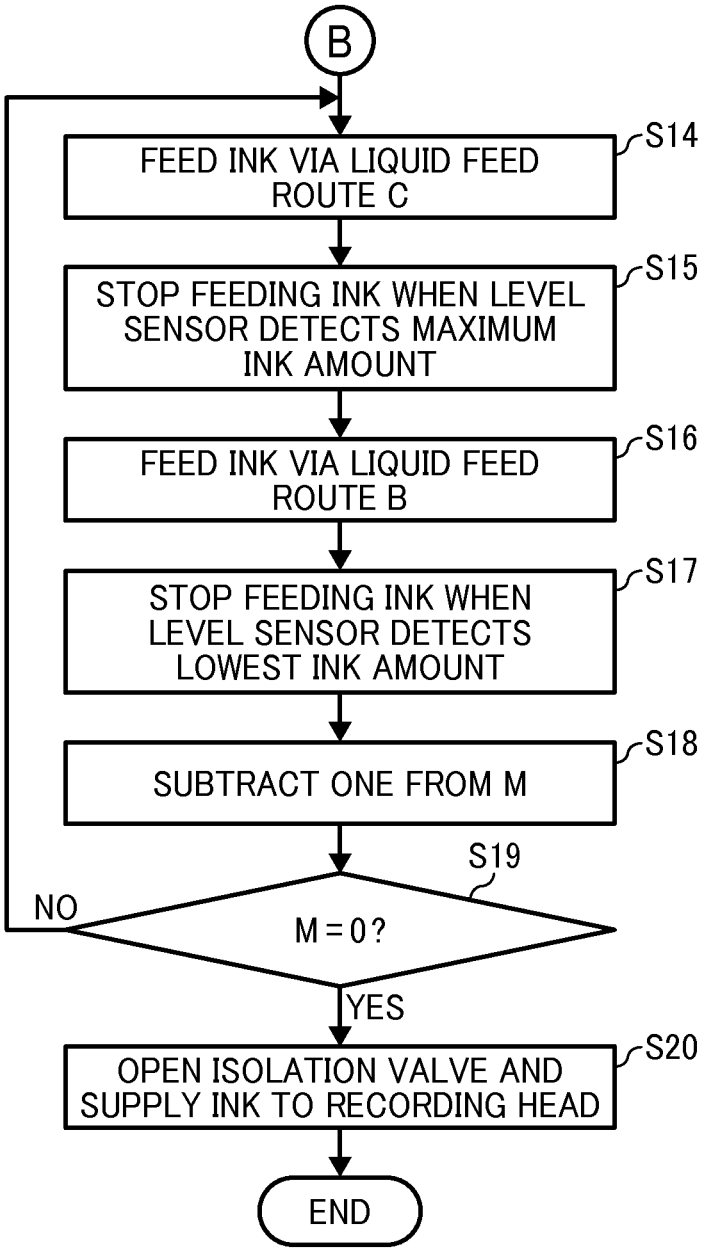
FIG. 11 is a flowchart illustrating stirring (third part) according to the sixth embodiment.

FIGS. 9 to 11 are flowcharts each illustrating stirring according to the present embodiments.

Suppose that the ink inside the cartridge 202 has been already stirred, but the ink inside the cartridge 201 needs stirring. Further, assume that the second container 102 is neither empty nor full.

First, in step S1, the controller 105 closes the isolation valve 302 disposed on the pipe 311, so that effects of the stirring do not adversely affect the recording head 305.

Next, in step S2, the controller 105 sets a maximum number Mmax of the number of times M the ink is pumped. Mmax can be determined based on information such as a type of ink and ink amount stored in the storage device 231, but alternatively may be a predetermined number. M is initially set to one.

Next, the process proceeds to step S3, and the controller 105 opens the gate valve of the pipe 211 and closes the gate valve of the pipe 212. Then, the controller 105 controls a direction of the flow of the reversible pump 104 such that the ink is conveyed from the cartridge 201 to the second container 102, and drives the reversible pump 104. Specifically, the ink is conveyed via a liquid feed route A as indicated by an arrow A in FIG. 8.

Next, the process proceeds to step S4, and the controller 105 stops the reversible pump 104 upon the upper sensor 109 detecting an upper limit ink amount, and stops feeding ink. In steps S3 and S4, part of the ink inside the cartridge 201 moves to the second container 102.

Next, the process proceeds to step S5, the controller 105 determines whether or not number of times M the ink is pumped reaches the maximum number Mmax. When the number M does not reach Mmax (No in S5), the process proceeds to step S6.

In step S6, the controller 105 adds one to the number of times M the ink is pumped.

Next, the process proceeds to step S7, and the controller 105 closes the gate valve of the pipe 211 and opens the gate valve of the pipe 212. Then, the controller 105 changes a direction of the flow of the reversible pump 104 such that the ink is conveyed from the second container 102 to the cartridge 202, and drives the reversible pump 104. Specifically, the liquid feed route A is closed, and the ink is conveyed via a liquid feed route D as indicated by an arrow D in FIG. 8.

In step S8, the controller 105 stops the reversible pump 104 upon the lower sensor 110 detecting a lower limit ink amount, and stops feeding ink. In steps S7 and S8, the ink inside the second container 102 moves to the cartridge 202. Thereafter, the process again returns to step S3.

Next, the process proceeds to step S5, the controller 105 determines whether or not number of times M the ink is pumped reaches the maximum number Mmax. In this case, the ink corresponding to the amount multiplied by Mmax has moved to the cartridge 202 from the cartridge 201. That is, the ink amount inside the cartridge 201 is reduced compared to the ink amount in the initial state.

In step S9, the controller 105 sets a maximum number Nmax of a number of ink movement or a number of times the ink is pumped N, other than the number M. The Nmax can be determined based on information such as type of ink and ink amount stored in the storage device 231, but alternatively may be a predetermined number. N is initially set to one.

Successively, the process proceeds to step S10. In the previous step, the ink has been conveyed via the liquid feed route A. Then, the controller 105 controls to reverse a direction of the flow of the reversible pump 104 and drives the reversible pump 104 again. Specifically, the controller 105 causes to start feeding liquid via the liquid feed route B as indicated by an arrow B in FIG. 8, not via the liquid feed route A. Upon the lower sensor 110 detecting the lowest ink amount, the controller 105 stops the reversible pump 104.

Next, the process proceeds to step S11, and the controller 105 determines whether or not the number of times the ink is pumped N reaches the maximum number Nmax. When the number N does not reach Nmax (No in S11), the process proceeds to step S12.

In step S12, the controller 105 adds one to the number of times the ink is pumped N. Successively, the process proceeds to step S13.

In the previous step, the ink has been conveyed via the liquid feed route B. Then, in step S13, the controller 105 controls to reverse a direction of the flow of the reversible pump 104 and drives the reversible pump 104 again. Specifically, the controller 105 causes to start feeding liquid via the liquid feed route A, not via the liquid feed route B. Upon the upper sensor 109 detecting a highest ink amount, the controller 105 stops the reversible pump 104. Thereafter, the process again returns to step S10.

On the other hand, in step S11, when the controller 105 determines whether or not the number of times the ink is pumped N reaches the maximum number Nmax (Yes in S11), the process proceeds to step S14. In this case, the ink inside the cartridge 201 is moved reciprocally by a number Nmax between the cartridge 201 and the second container 102, so that the ink inside the cartridge 201 has been satisfactorily stirred.

In step S14, the controller 105 closes the gate valve of the pipe 211 and opens the gate valve of the pipe 212. Then, the controller 105 controls to reverse a direction of the flow of the reversible pump 104 such that the ink is conveyed from the cartridge 202 to the second container 102, and drives the reversible pump 104 again. Specifically, the controller 105 closes the liquid feed route B and causes the ink to be conveyed via a liquid feed route C as indicated by an arrow C in FIG. 8.

Next, the process proceeds to step S15, and the controller 105 stops the reversible pump 104 upon the upper sensor 109 detecting an upper limit ink amount, and stops feeding ink. In steps S14 and S15, the ink inside the cartridge 202 is moved to the second container 102.

Next, the process proceeds to step S16, and the controller 105 opens the gate valve of the pipe 221 and closes the gate valve of the pipe 222. Then, the controller 105 controls a flowing direction of the reversible pump 104 so that the ink is conveyed from the second container 102 to the cartridge 201. Specifically, the controller 105 closes the liquid feed route C and causes the ink to be fed via the liquid feed route B.

Next, the process proceeds to step S17, and the controller 105 stops the reversible pump 104 upon the lower sensor 110 detecting the lower limit ink amount, and stops feeding ink. Via the steps S16 and S17, the ink inside the second container 102 is moved to the cartridge 201.

Next, the process proceeds to step S18, and the controller 105 subtracts one from number of times M the ink is pumped. Successively, the process proceeds to step S19.

In step S19, when the controller 105 determines that the number of times M the ink is pumped is not "0" (zero) (No in S19), the process returns to step S14.

On the other hand, in step S19, when the controller 105 determines that the number of times M the ink is pumped is "0" (zero) (Yes in S19), the process proceeds to step S20. In this case, the ink inside the cartridge 202 has returned to the cartridge 201 via the second container 102. That is, the ink amount inside the cartridge 201 is recovered to the ink amount in the initial state.

In step S20, the controller 105 opens the isolation valve 302 of the pipe 311. Then, the controller 105 drives the pump 301 to supply ink from the second container 102 to the sub tank 303, the manifold 304, and the recording head 305, and the stirring is completed.

As described above, in the stirring method according to the present embodiment, the ink inside the cartridge 201 is temporarily moved to the cartridge 202 and is reciprocally moved between the cartridge 201 and the second container 102, so that the ink inside the cartridge 201 is stirred. Specifically, the amount of ink inside the cartridge 201 is first reduced, and the ink is reciprocally moved with a reduced ink amount, so that the stirring performance is improved and the ink can be stirred in a less number of moving times. As a result, the stirring time period can be shortened.

The cartridges 201, 202 may employ lower sensors 241, 242 (similar to the lower sensor 110) to detect a lower limit of the ink. In this case, a correct amount of ink inside the cartridge can be obtained, so that the time period in which the reciprocal movement of the ink is performed can be shortened.

In the above embodiments the number of cartridges is two, but is not limited thereto. When three or more cartridges are used, the cartridges can be selectively stirred, or alternatively, all the cartridges can be stirred sequentially. When all the cartridges are stirred, the order of stirring can be previously set, but may be defined by the data stored in the storage device of each cartridge.

Additional modifications and variations of the present invention are possible in light of the above teachings. It is therefore to be understood that, within the scope of the appended claims, the invention may be practiced other than as specifically described herein.

What is claimed is:

1. A liquid stirrer comprising:

a removable first liquid container to contain a liquid including at least one ingredient in solution, the first liquid container including a storage device that registers information including a liquid type of the liquid contained in the first liquid container;

a second liquid container having a capacity less than that of the first liquid container;

a fluid path between the first liquid container and the second liquid container;

a reversible pump disposed on the fluid path;

a sensor to detect an amount of the liquid inside the second liquid container; and a controller to control the reversible pump, based on an output signal from the sensor, to control movement of the liquid between the first liquid container and the second liquid container, wherein the controller, upon determining based on the output signal from the sensor that the amount of the liquid inside the second liquid container has reached a predetermined upper limit, stops the reversible pump to stop movement of the liquid from the first liquid container to the second liquid container, and controls the reversible pump to reverse a direction of flow, to move liquid from the second liquid container to the first liquid container, until a predetermined amount of liquid has moved from the second liquid container to the first liquid container, and wherein the controller controls movement of the liquid based on the registered information retrieved from the storage device.

2. The liquid stirrer as claimed in claim 1, wherein the controller causes to be registered, in the storage device, a stir date and a number of times the liquid is pumped, and causes the liquid to be stirred after a predetermined time has elapsed after a last stir date.

3. The liquid stirrer as claimed in claim 1, wherein the storage device further registers information indicating an amount of the liquid and a stir date and time of the liquid.

4. The liquid stirrer as claimed in claim 3, wherein the controller determines, based on at least the information retrieved from the storage device indicating the liquid type of the liquid contained in the first liquid container, a number of times the liquid is to be pumped and a frequency of stirring of the liquid.

5. The liquid stirrer as claimed in claim 1, wherein the sensor includes an upper sensor to detect an upper limit of the amount of the liquid disposed on an upper part of the second liquid container and a lower sensor to detect a lower limit of the amount of the liquid disposed on a lower part of the second liquid container.

6. The liquid stirrer as claimed in claim 1, wherein the second liquid container is formed of a flexible material.

7. The liquid stirrer as claimed in claim 1, further comprising another first liquid container to contain the liquid, wherein each of the liquid container and the another first liquid container are connected to a corresponding pipe provided with a gate valve controlled by the controller, wherein the pipe is connected in parallel with the fluid path.

8. The liquid stirrer as claimed in claim 7, wherein the controller controls the reversible pump to convey the liquid between the first liquid container and said another first liquid container.

9. The liquid stirrer as claimed in claim 7, wherein the controller controls the reversible pump to move part of the liquid inside one of the first liquid container and the another first liquid container to another of the first liquid container and the another first liquid container and stir a residual liquid contained in the first liquid container.

10. An image forming apparatus comprising:

the liquid stirrer as claimed in claim 1;

an image forming unit including a plurality of recording heads, to form an image on an recording medium by ejection of droplets of the liquid; and a liquid supplier to supply the liquid from the liquid stirrer to the plurality of recording heads of the image forming unit.

11. The liquid stirrer as claimed in claim 1, wherein the controller controls the reversible pump, based on readings from the sensor, to pump the liquid from the removable first liquid container to the second liquid container, and subsequently to pump the liquid in the second liquid container to the first liquid container, to stir the liquid to maintain uniform density of the liquid.

12. A liquid stirrer comprising:

a removable first liquid container to contain a liquid including at least one ingredient in solution, the first liquid container including a storage device that registers information including a liquid type of the liquid contained in the first liquid container;

a second liquid container having a capacity less than that of the first liquid container;

a fluid path between the first liquid container and the second liquid container;

a reversible pump disposed on the fluid path to move the liquid between the first liquid container and the second liquid container;

a sensor to detect an amount of the liquid inside the second liquid container; and a controller to control, based on an output signal from the sensor, driving and stopping the reversible pump, to control movement of the liquid between the first liquid container and the second liquid container, wherein the controller, upon determining based on the output signal from the sensor that the amount of the liquid inside the second liquid container has reached a predetermined upper limit, stops the reversible pump to stop movement of the liquid from the first liquid container to the second liquid container, and controls the reversible pump to reverse a direction of flow, to move liquid from the second liquid container to the first liquid container, until a predetermined amount of liquid has moved from the second liquid container to the first liquid container, and wherein the controller controls movement of the liquid based on the registered information retrieved from the storage device.

13. The liquid stirrer as claimed in claim 12, wherein the controller causes to be registered, in the storage device, a stir date and a number of times the liquid is pumped, and the controller causes the liquid to be stirred after a predetermined time has elapsed after a last stir date.

14. The liquid stirrer as claimed in claim 12, wherein the storage device further registers information indicating an amount of the liquid, and a stir date and time of the liquid, and the controller determines, based on at least the information retrieved from the storage device indicating the liquid type of the liquid contained in the first liquid container, a number of times the liquid is to be pumped and a frequency of stirring of the liquid.

15. The liquid stirrer as claimed in claim 12, wherein the sensor includes an upper sensor to detect an upper limit of the amount of the liquid disposed on an upper part of the second liquid container and a lower sensor to detect a lower limit of the amount of the liquid disposed on a lower part of the second liquid container.

16. The liquid stirrer as claimed in claim 12, wherein the second liquid container is formed of a flexible material.

17. The liquid stirrer as claimed in claim 12, further comprising another first liquid container to contain the liquid, wherein each of the liquid container and the another first liquid container are connected to a corresponding pipe provided with a gate valve controlled by the controller, wherein the pipe is connected in parallel with the fluid path.

18. An image forming apparatus comprising:

the liquid stirrer as claimed in claim 12;

an image forming unit including a plurality of recording heads, to form an image on an recording medium by ejection of droplets of the liquid;

a liquid supplier to supply the liquid from the liquid stirrer, to the plurality of recording heads of the image forming unit.

19. The liquid stirrer as claimed in claim 1, wherein the controller controls the reversible pump to agitate the liquid moving between the first liquid container and the second liquid container and thereby cause the ingredient in the liquid not to precipitate.

* * * * *